United States Patent [19]

Amano et al.

[11] Patent Number: 4,857,796

[45] Date of Patent: Aug. 15, 1989

[54] CATHODE-RAY TUBE WITH ELECTROSTATIC CONVERGENCE MEANS AND MAGNETIC MISCONVERGENCE CORRECTING MECHANISM

[75] Inventors: Yasunobu Amano, Tokyo; Masayuki Sudo, Kanagawa, both of Japan

[73] Assignee: Sony Corporation, Tokyo, Japan

[21] Appl. No.: 137,577

[22] Filed: Dec. 24, 1987

[30] Foreign Application Priority Data

Dec. 27, 1986 [JP] Japan ..... 61-309736

[51] Int. Cl.[4] ..... H01J 29/72; H01J 29/51

[52] U.S. Cl. ..... 313/428; 313/431; 313/433; 313/437; 313/439

[58] Field of Search ..... 313/432, 439, 437, 433, 313/431, 428

[56] References Cited

U.S. PATENT DOCUMENTS

| | | | |
|---|---|---|---|
| 2,849,647 | 8/1958 | Francken | 313/428 X |
| 3,462,638 | 8/1969 | Tetsuo et al. | 313/428 X |
| 3,898,521 | 8/1975 | Saito et al. . | |
| 4,682,073 | 7/1987 | Staub | 313/431 X |

FOREIGN PATENT DOCUMENTS

| | | | |
|---|---|---|---|
| 0090107 | 10/1983 | European Pat. Off. | 313/431 |
| 0125949 | 11/1984 | European Pat. Off. . | |
| 2438254 | 2/1975 | Fed. Rep. of Germany | 313/431 |
| 1082546 | 9/1967 | United Kingdom . | |
| 1195598 | 6/1970 | United Kingdom . | |
| 1436925 | 5/1976 | United Kingdom . | |
| 1604169 | 12/1981 | United Kingdom . | |
| 2151396 | 12/1984 | United Kingdom . | |

*Primary Examiner*—Palmer C. DeMeo

*Attorney, Agent, or Firm*—Hill, Van Santen, Steadman & Simpson

[57] ABSTRACT

A cathode-ray tube which has an electron gun and a correcting unit with a magnetic device electrically coupled to a final electrode of the electron gun so as to selectively apply a uniform magnetic field to required ones of a plurality of electron beams, so as to thereby correct the path of a selected electron beam without causing distortion in the shape of the beam spot.

2 Claims, 5 Drawing Sheets

FIG. 2
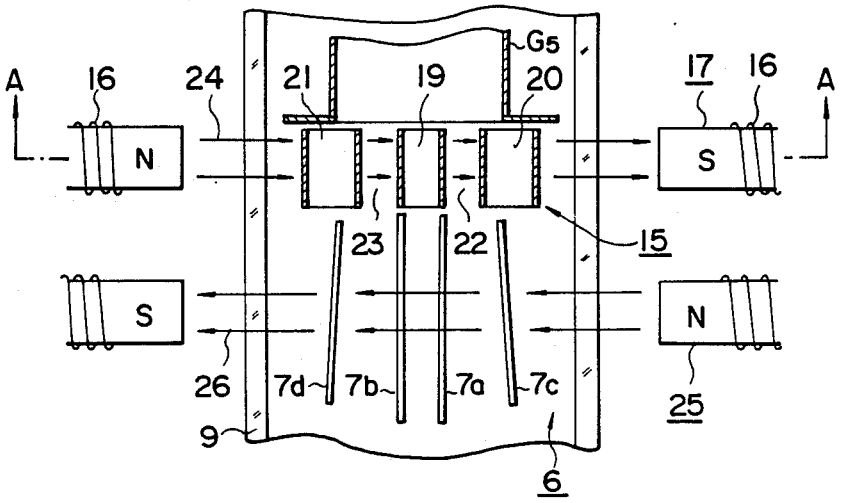
FIG. 3
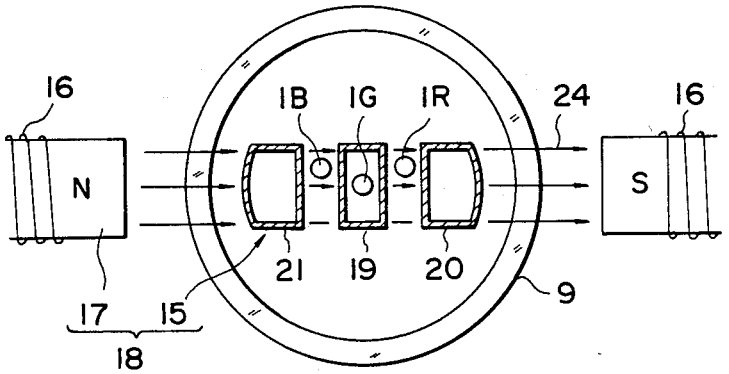
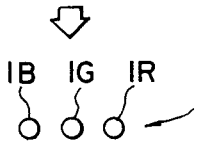
FIG. 3A

FIG. 4A
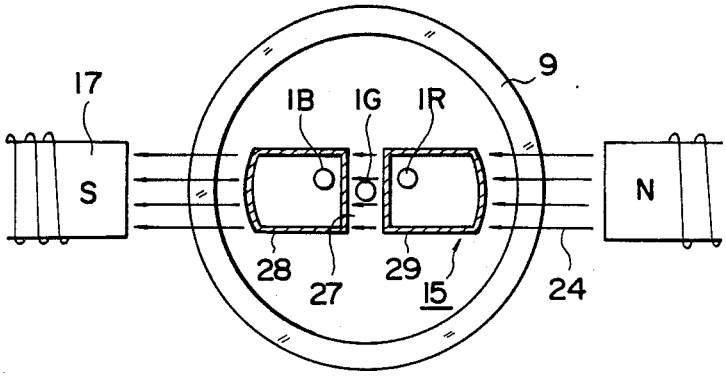
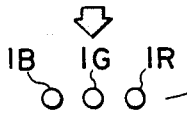
FIG. 4B
FIG. 5
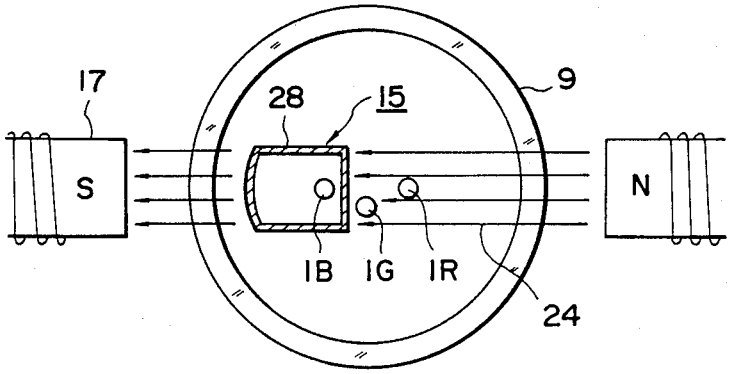
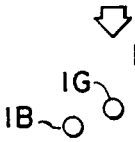
FIG. 5C

CATHODE-RAY TUBE WITH ELECTROSTATIC CONVERGENCE MEANS AND MAGNETIC MISCONVERGENCE CORRECTING MECHANISM

BACKGROUND OF THE INVENTION

1. Field of the Invention

The present invention relates to a cathode-ray tube (CRT) which has a plurality of electron beams, and in particular, to a correction system for correcting vertical misconvergence which appears to be unsymmetrical upwardly and/or downwardly with respect to a center beam.

In a cathode-ray tube according to the present invention which has a plurality of electron beams, a uniform magnetic field is selectively applied to a required one of the electron beams with a magnetic member which is electrically coupled to a final electrode of an electron gun so as to correct the vertically unsymmetrical misconvergence without causing distortion in the shape of any of the beam spots.

2. Description of the Prior Art

In cathode-ray tubes which have a plurality of electron beams of an in-line array and which are deflected for scanning a striped color luminescent screen, misconvergence which occurs at a faceplate includes horizontal misconvergence and vertical misconvergence. FIG. 8A shows the normally converged state of electron beams 1R, 1G, and 1B which are respectively associated with red, green and blue on the luminescent screen. The horizontal misconvergence includes a horizontally symmetrical misconvergence in which the side beams 1R and 1B deviate from the center beam 1G, as shown in FIG. 8D, equidistantly and symmetrically in the horizontal direction and a horizontally unsymmetrical misconvergence in which a beam, for example, the beam 1B on one side deviates from the center beam 1G in the horizontal direction as shown in FIG. 8E.

Also, the vertical misconvergence is also classified into vertically symmetrical misconvergence in which both of the side beams 1R and 1B are unsymmetrically shifted from the center beam 1G in the vertical direction as shown in FIG. 8C. In an ordinary case, the misconvergence results from a combination of the symmetrical or unsymmetrical horizontal misconvergence with the symmetrical or unsymmetrical vertical misconvergence. Consequently, a necessary correction has been made to correct the misconvergence.

The apparatus of the present invention particularly relates to a system for the correction of unsymmetrical vertical misconvergence. In the conventional method of correcting such vertical unsymmetrical misconvergence, the correction has been commonly achieved by means of a six-pole magnet 2 disposed, for example, outside of a tube body at a location associated with the final electrode of an electron gun as shown in FIG. 7A. In this configuration, when a magnetic field is applied from the six-pole magnet 2, forces F1 and F2 are exerted on the side beam 1B, which is accordingly displaced downwardly as indicated by the dotted line, whereas forces F3 and F4 are applied to the side beam 1R, which is therefore shifted downwardly as represented by a dotted line, thereby effecting the correction of the unsymmetrical vertical misconvergence of the three beams 1R, 1G, and 1B (FIG. 7B).

In a case, however, where the vertically unsymmetrical misconvergence is corrected by means of the six-pole magnet 2, the beam spots of the side beams 1R and 1B are distorted in shape as shown in FIG. 7B, which causes a deterioration of resolution. In other words, the beam 1B on the left side of FIG. 7A is affected by a divergent action of the force F2 in a +45° direction and is simultaneously affected by a convergent action of the force F1 in a −45° direction, which results in an overfocused condition in the −45° direction. As a consequence, the beam spot is obliquely distorted in shape and has a halo 3. On the other hand, the beam 1R on the right side is caused to have a spot shape which is distorted in the reverse direction. Consequently, the respective spots of the beams 1R, 1G, and 1B are different from each other in shape and hence there arises a problem that the shapes of the beam spots cannot be simultaneously corrected by any known method. Heretofore, it has been impossible to achieve an appropriate correction of the beam spot distortion caused by the six-pole magnet 2. Particularly, in a tube having high precision, the distortion of the beam spot causes considerable deterioration of the resolution.

SUMMARY OF THE INVENTION

It is therefore an object of the present invention to provide a cathode-ray tube in which an unsymmetrical vertical misconvergence can be corrected without causing distortion of any of the beam spots, thereby solving the problems of the prior art technology.

According to the present invention, there is provided a cathode-ray tube which has a plurality of electron beams 1R, 1G, and 1B of an in-line array and includes a correcting mechanism 18 having a magnetic member 15 which is electrically coupled to a stage after the final electrode of an electron gun so as to correct the beam path by selectively applying a uniform magnetic field to required ones of the electron beams 1R, 1G, and 1B.

The correcting mechanism 18 includes the magnetic member 15 and means 17 for generating a uniform magnetic field such as a magnetic which has a magnetic core and a coil 16 wound therearound so as to apply a uniform magnetic field to the magnetic member 15 from outside of the tube body. Particularly, the magnetic member 15 includes a magnetic portion for concentrating a uniform magnetic field on the required one of the electron beams and a magnetic portion for shielding the other electron beams from the uniform magnetic field.

When a uniform magnetic field is applied to the magnetic member 15 from the magnetic field generating means 17 disposed outside of the tube body, the other electron beams other than the required one are not influenced by the uniform magnetic field because the electron beams are shielded. In contrast, the required electron beam is located in the uniform magnetic field which is applied from the magnetic portion of the magnetic member 15, so as to thereby correct the beam path in the vertical direction and hence the vertically unsymmetrical misconvergence. In this operation, the beam spot is not distorted because the applied magnetic field includes only a uniform magnetic field.

BRIEF DESCRIPTION OF THE DRAWINGS

The objects and features of the present invention will become more apparent from the consideration of the following detailed description taken in conjunction with the accompanying drawings in which:

FIG. 2 is an enlarged cross-sectional view illustrating primary components of FIG. 1;

FIG. 3 is a sectional view of the embodiment taken along the line A—A of FIG. 2;

FIG. 3A illustrates the position of the beams;

FIG. 4A is a sectional view illustrating an alternative embodiment of the invention;

FIG. 4B illustrates the beam positions;

FIG. 5 is a sectional view illustrating another alternative embodiment;

FIG. 5A illustrates the beam positions.

DESCRIPTION OF THE PREFERRED EMBODIMENTS

Referring now to the accompanying drawings, a description will be given for embodiments of a cathode-ray tube having a single electron gun of an in-line multibeam type according to the present invention.

Figure 1:
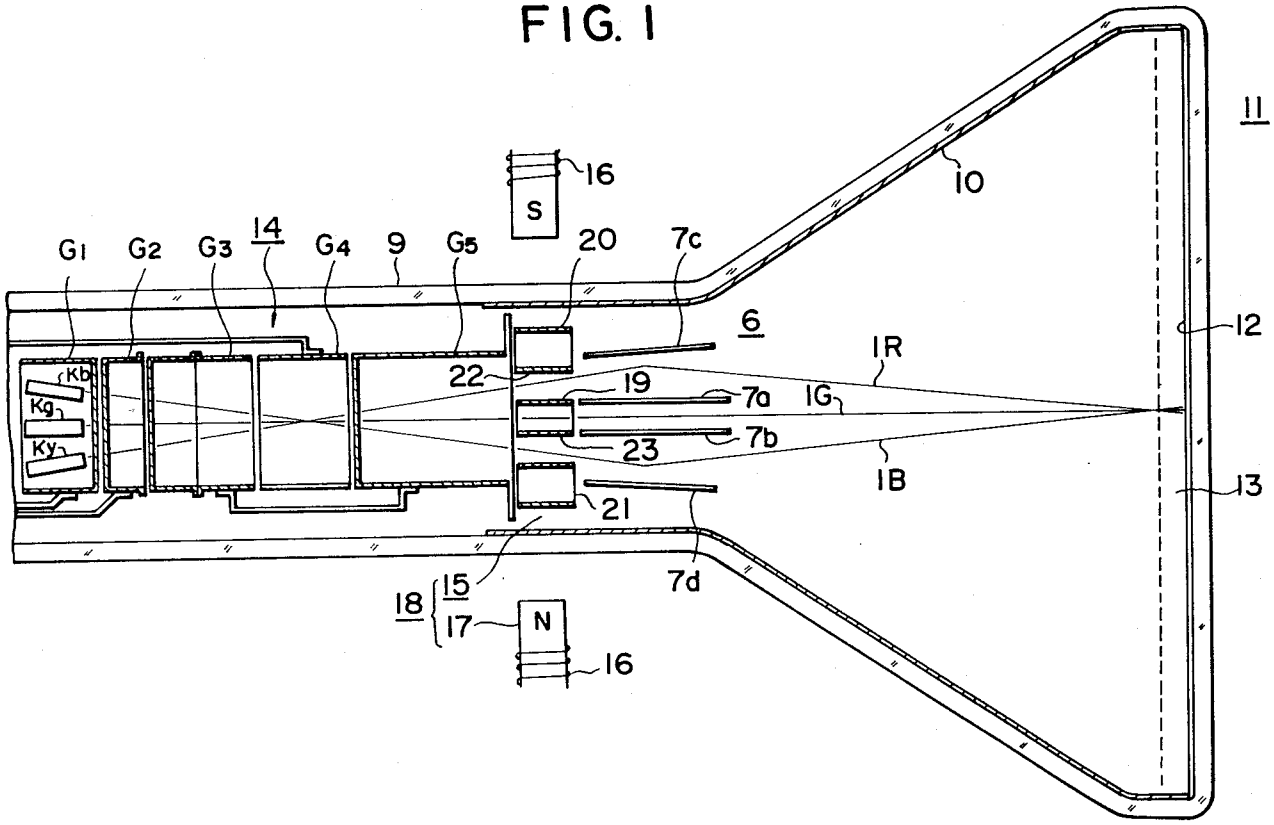
FIG. 1 is a schematic diagram illustrating a cross-section of a cathode-ray tube embodiment according to the present invention.

The configuration of FIG. 1 includes a cathode-ray tube 11 which has a striped color luminescent screen 12 in which red, green, and blue are deposited in the form of stripes on the inner surface of a panel. A color selecting electrode 13 such as an aperture grille is mounted opposite the color luminescent screen. An inner conductive film 10 is formed on the tube and an electron gun 14 disposed in the neck 9. The electron gun 14 includes three cathodes Kr, Kg, and Kb which respectively correspond to red, green and blue and which are arrayed on a horizontal inner surface. In common to the cathodes K, there are sequentially mounted along an axis a first grid G1, a second grid G2, a third grid G3, a fourth grid G4, and a fifth grid G5. An electrostatic convergence means 6 is located in a stage after to the fifth grid G5.

The electrostatic convergence means 6 has inner deflection electrodes *7a* and *7b* which oppose each other and outer deflection electrodes *7c* and *7d* which respectively oppose at outer positions as shown. The third grid G3, the fourth grid G4, and the fifth grid G5 form a main electron lens which is common to the electron beams 1R, 1G and 1B. The electron beams 1R, 1G, and 1B intersect each other substantially at the center of the main electron lens and are then diverged therefrom such that the center beam 1G passes between the inner deflection electrodes *7a* and *7b* of the convergence means 6, whereas the side beam 1R passes between the inner deflection electrode *7a* and the outer deflection electrodes *7c* and the side beam 1B passes between the inner deflection electrode *7b* and the outer deflection electrode *7d*, which converge the beams on the color luminescent screen 13.

An anode voltage which is equivalent to the voltage of the fifth grid G5 is applied to the inner deflection electrodes *7a* and *7b* of the convergence means 6, and a convergence voltage which is a high voltage but which is lower than the anode voltage is applied to the outer deflection electrodes *7c* and *7d*.

In this embodiment, a correcting mechanism 18 is disposed between the final electrode, namely, the fifth grid G5 of the electron gun 14 and the electrostatic convergence means 6 and comprises a magnetic metal member 15 which is coupled so as to have the same potential as the fifth grid G5. A magnet 17 is mounted outside of the neck 9 opposite the magnetic metal member 15. The magnet 17 includes a magnetic core and a coil 16 which is wound therearound so as to apply a uniform magnetic field to the magnetic metal member 15. The magnetic metal member 15 has a center cylindrical portion 19 through which the center beam 1G passes which shields it from the uniform magnetic field and the outer cylindrical portions 20 and 21 which are mounted on two sides of the center cylindrical portion 19 with a predetermined space between them. The portions 20–21 serve to concentrate the uniform magnetic field on the side beams 1R and 1B which pass through the spaces 22 and 23 which are between the two side surfaces of the center cylindrical portion 19 and the outer cylindrical portions 20 and 21. In this configuration, the respective opposing surfaces of the center cylindrical portion and the outer cylindrical portions 20–21 are shaped so as to be flat surfaces which are parallel to each other.

A description of the operation of the embodiment follows.

As shown in FIGS. 2–3, a uniform magnetic field 24 is generated by the magnet 17 outside of the neck and is applied to the magnetic metal member 15 and is then concentrated in the spaces 22–23 by the center cylindrical portion and the outer cylindrical portions 20–21.

Three electron beams 1R, 1G, and 1B which are in a state which causes unsymmetrical vertical misconvergence are supplied into the magnetic metal member 15 via the fifth grid G5 as shown in FIG. 3. The center beam 1G passes through the shielded hollow portion 19, whereas the side beams 1R and 1B respectively pass through the spaces 22 and 23 and are influenced by the common uniform magnetic field 24 and are thereby displaced downwardly relative to FIG. 3. Consequently, the vertically unsymmetrical misconvergence is corrected as indicated in FIG. 3A. This correction prevents the beam spots from being distorted because the magnetic field which is applied to the side beams 1R and 1B comprises only the uniform magnetic field 24.

Figure 6A:
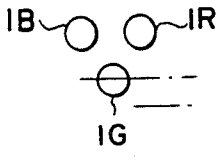
FIGS. 6A–6C are explanatory diagrams useful to explain the operation of the cathode-ray tube according to the present invention.
Figure 6B:
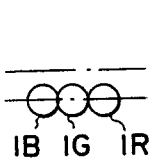
Figure 6C:
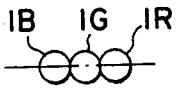
Figure 7A:
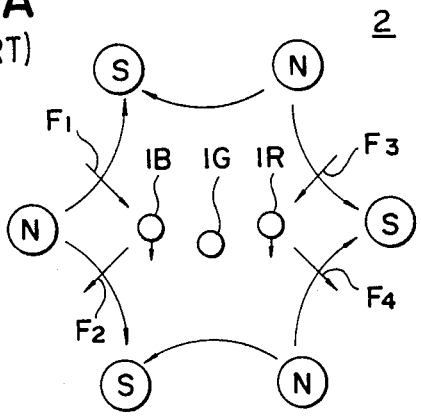
FIG. 7A (PRIOR ART)
FIGS. 7A and 7B are explanatory diagrams useful to explain a method of correcting the vertically unsymmetrical misconvergence with the conventional six-pole magnet.
Figure 7B:
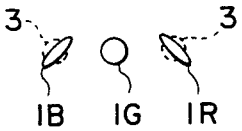
FIG. 7B (PRIOR ART)
Figure 8A:
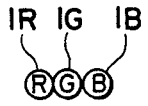
FIGS. 8A through 8E are explanatory diagrams useful for explaining an example of the misconvergence.
Figure 8B:
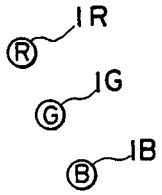
Figure 8C:
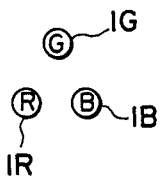
Figure 8D:
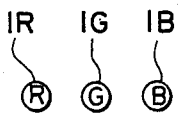
Figure 8E:
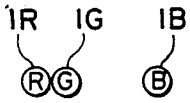

Incidentally, because of the expansion of the uniform magnetic field in the magnetic metal member 15, the magnetic field will not be completely shielded from the center beam 1G. Consequently, the center beam 1G including the side beams 1R and 1B is displaced downwardly as shown in FIG. 6B. In order to correct the downward displacement, a magnet 25 which has a structure which is similar to that of the magnet 17 described above is mounted at a position where the magnetic metal member 15 is not present; for example, outside of the neck opposite to the electrostatic convergence means 6 as illustrated in FIG. 2, and a uniform magnetic field 26 which has a direction opposite to the uniform magnetic field in the magnetic metal member 15 is applied at the position of the electrostatic convergence means 6. As a result, the displacement of the center beam 1G including the side beams 1R and 1B is canceled out and hence the three beams 1R, 1G, and 1B are corrected with respect to the unsymmetrical vertical misconvergence and they can be restored to the appropriate correct positions as shown in FIG. 6C. Also in this situation, the beam spots are not distorted since the magnetic field which is applied to the three beams 1R, 1C and 1B includes only the uniform magnetic field 26. FIG. 6B shows the positions of the electron beams 1R, 1G, and 1B before correction. The uniform magnetic field 26 is applied in the reverse direction but it may be omitted in those cases where the amount of the correction is small.

Furthermore, when a signal having a parabolic waveform is superimposed onto the current which flows in the coil 16 of the magnet 17 which applies a uniform magnetic field 24 to the magnetic metal member 15, the dynamic unsymmetrical vertical misconvergence can be corrected in the respective portions of the screen.

In a conventional six-pole magnet system, for example, in a large-sized cathode-ray tube which uses such system, the spot size of the side beam is deteriorated by 70% to 80% due to the correction of the unsymmetrical vertical misconvergence of 1 mm. According to the present invention, however, the beam spot size is substantially not deteriorated in the correction of the convergence of 1 mm, and only a deterioration of 5% results from the correction of 3 mm.

FIG. 4 shows another example of the magnetic metal member 15. In this example, the magnetic metal member 15 comprises two hollow portions 28–29 mounted on two sides of a space 27 which is provided as a passage for the center beam 1G and the two side beams 1B and 1R pass through portions 28 and 29 and they shield the beams 1B and 1R from the uniform magnetic field 24. Consequently, the hollow portions 28 and 29 also serve the function so as to concentrate the uniform magnetic field in the space 27 formed therebetween. In this configuration, the side beams 1B and 1R pass through the shielded hollow portions 28 and 29, and the center beam 1G is affected by the uniform magnetic field 24 and is displaced upwardly (FIG. 4), and hence the vertically unsymmetrical misconvergence is corrected as indicated by FIG. 4B.

FIG. 5 is a schematic diagram showing another example of the magnetic metal member 15. In this example, the magnetic metal member 15 includes a hollow portion 28 through which one side beam passes, for example, the side beam 1B and portion 28 shields the side beam 1B from the uniform magnetic field 24. In such a construction, both the center beam 1G and the other side beam 1R are displaced upwardly by the common uniform magnetic field 24 (FIG. 5), which thereby corrects the vertically unsymmetrical misconvergence as indicated by FIG. 5C, and the unsymmetrical vertical misconvergence is corrected so that a state of a symmetrical vertical convergence, exists which can be corrected by a symmetrical vertical misconvergence correcting means (not shown) which is located in a stage before or after the correcting mechanism 18.

In the examples, described above, although the present invention is applied to a cathode-ray tube which includes a single electron gun of the multibeam-type in which electrostatic convergence means is integrally disposed, the present invention can also be applied to other cathode-ray tubes, for example, a cathode-ray tube having three electron guns in an in-line array. In such a case, a magnetic metal member is arranged in association with the final electrode of each electron gun.

Furthermore, the present invention is also applicable to other cathode-ray tubes having multibeams such as three or more beams.

According to the present invention, a magnetic member is coupled to the final electrode of an electron gun and has the same potential as the final electrode and a uniform magnetic field which is applied from the outside of the neck is selectively concentrated on required ones of a plurality of electron beams, thereby correcting the unsymmetrical vertical misconvergence without causing distortion in the shape of any of the beam spots. Furthermore, current is supplied to the coil of the magnet which is located outside of the neck so as to generate a uniform magnetic field and is controlled so as to enable to correct the unsymmetrical vertical misconvergence which is induced by electromagnetic deflection in any portion of the screen and at the center thereof without distorting the shape of the respective beam spots. As a consequence, according to the present invention, the degree of freedom in designing the deflection yoke can be increased and manufacturing errors of the electron gun can be compensated.

While the present invention has been described with reference to the particular embodiments, it is not restricted by those embodiments but only by the appended claims. It is to be appreciated that those skilled in the art can change and modify the embodiments without departing from the scope and spirit of the invention.

We claim as our invention:

1. In a cathode-ray tube which has an envelope in which red, blue and green electron guns are mounted in one end which produce three color beams and a luminescent screen on the other end of the tube, a color selecting electrode mounted adjacent said luminescent screen, a plurality of grids mounted in said envelope and positioned so as to effect the electron beams from said red, blue and green electron guns, a convergence means comprising first, second, third and fourth conducting plates mounted between said fifth grid and said color selecting electrode and positioned so that one of said three color beams passes between said first and second conducting plates, a second one of said three color beams passes between said second and third conducting plates and a third one of said three color beams passes between said third and said fourth conducting plates, the improvement comprising, a correcting mechanism for correcting the vertical unsymmetrical misconvergence in said cathode tube including a magnet mounted outside said envelope and having a magnetic core with a south pole mounted on one side of said envelope and a north pole on the other side of said envelope so that flux passes between said north and south poles and a first magnetic metallic member which is hollow and has two opposite flat sides which are normal to the magnetic field of said magnet mounted in said envelope such that one of said three color beams passes therethrough so as to shield it from magnetic flux from said magnet, and including second and third hollow magnetic metallic members on opposite sides of said first electrically conductive member and a second one of said three color beams passes between said first and second hollow magnetic metallic members and a third of said three color beams passes between said first and third members.

2. In a cathode ray tube according to claim 1 wherein said second and third members have at least one planar wall which are adjacent to said said first member.

* * * * *